US005947382A

United States Patent [19]

Kelly

[11] Patent Number: 5,947,382

[45] **Date of Patent: *Sep. 7, 1999**

[54] SERVO CONTROLLED COMMON RAIL INJECTOR

[75] Inventor: William W. Kelly, Granby, Conn.

[73] Assignee: Stanadyne Automotive Corp., Windsor, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/873,279

[22] Filed: Jun. 11, 1997

[51] Int. Cl.[6] ..... F02M 47/02; F02M 57/00

[52] U.S. Cl. ..... 239/127; 239/533.8

[58] Field of Search ..... 239/533.8, 93, 239/94, 124, 127

[56] References Cited

U.S. PATENT DOCUMENTS

| | | | |
|---|---|---|---|
| 3,481,542 | 12/1969 | Huber | 239/94 X |
| 4,418,870 | 12/1983 | Mowbray | 239/533.8 |
| 4,566,635 | 1/1986 | Trachte | 239/533.8 |
| 4,946,106 | 8/1990 | Turchi et al. | 239/533.8 X |
| 4,962,887 | 10/1990 | Matsuoka | 239/533.8 X |

FOREIGN PATENT DOCUMENTS

| | | | |
|---|---|---|---|
| 112793 | 12/1939 | Australia | 239/533.8 |
| 2301679 | 7/1974 | Germany | 239/533.8 |

*Primary Examiner*—Kevin Weldon
*Attorney, Agent, or Firm*—Alix, Yale & Ristas, LLP

[57] ABSTRACT

A fuel injector to inject fuel into a cylinder of an internal combustion engine when installed therein, the engine having a high-pressure fuel supply which delivers fuel to the injector and a low-pressure fuel return which removes fuel from the injector. The injector has an injector body which defines an interior cavity, a movable needle valve which cooperates with the interior body to define a variable-volume control chamber and another value for selectively permitting fluid communication between the control chamber and (1) the high-pressure fuel supply; and (2) the low pressure fuel return. Such fluid communication permits controlled variation of the volume of the control chamber which, in turn, varies the position of the needle valve to selectively permit or prevent fluid communication between the high-pressure fuel supply and the engine cylinder. The valve for selectively permitting fluid communication is preferably force balanced by relatively low forces acting thereon.

17 Claims, 6 Drawing Sheets

SERVO CONTROLLED COMMON RAIL INJECTOR

BACKGROUND OF THE INVENTION

1. Field of the Invention

The present invention generally relates to fluid injectors for delivering high pressure fluid in a controlled manner. More particularly, the invention relates to an improved fuel injection nozzle for supplying fuel to an internal combustion engine. Accordingly, the general objects of the present invention are to provide novel and improved methods and apparatus of such character.

2. Description of the Related Art

Fuel injection nozzles for supplying fuel to internal combustion engines are well known in the art. Such injectors typically employ an injector body which is affixed to an internal combustion engine such that one end thereof extends into an engine cylinder. The injector body defines an interior cavity which is fluidly connected with a fuel supply and includes a needle valve which cooperates with the injector body to selectively permit fluid received from the fuel supply to pass through the interior cavity of the injector body and into the engine cylinder. Since most internal combustion engines employ a plurality of cylinders, it is common to employ one or more of such injectors with each engine cylinder. Recent developments have focused on supplying fuel to these multiple injectors from a common fuel supply rail.

One type of injector described above is shown in FIG. 1A, the injector being shown in the non-injection phase of the injection cycle. The common rail injector 10 of FIG. 1 employs a hydraulic force imbalance scheme wherein a power piston 12 disposed at one end of a needle valve 14 cooperates with other components to control the net system forces acting upon the needle valve 14. In the design shown, a control chamber 16 which lies adjacent one end of the power piston 12 contains a volume of high-pressure fuel during the non-injection phase of the injection cycle. The force of this high-pressure fuel acts downwardly on the power piston 12 to oppose the upward force of the high-pressure fuel acting on annular seal 17 to thereby urge an opposite end 20 of the needle valve 14 to sealingly engage an apertured nozzle 22 of an injector body 24. In this state, the fuel supplied to the injector 10 is not permitted to pass into the engine cylinder. However, the pressure within the control chamber 16 can be relieved by energizing a solenoid actuator 30 to move a valve 26 and open a spill path 28 from the control chamber 16 to low pressure return 27 thereby decreasing the pressure in the control chamber 16. When the pressure within the control chamber 16 drops to a predetermined level, based on the geometry of various injector components, the needle valve 14 moves upwardly to permit fuel to flow through the injector body 24 and into the engine cylinder. De-energizing the solenoid actuator 30 closes the fuel spill path 28. The pressure within the control chamber 16 then increases until it overcomes the upward force acting on the seal 17 and the needle valve 14 is again urged into its initial position. With the fuel injection cycle, thus, completed, it can be repeated as desired.

Fuel injectors of the type discussed above suffer from a number of deficiencies which tend to limit overall performance. First, such injectors suffer from the limitation that they can only control opening and closing of the injector nozzle like a switch. Aside from transient needle movement, such "switch-type" injectors only permit the needle valve to maintain fully-open or fully-closed positions. Thus, they are not capable of modulating the needle valve position between these two extremes.

An additional deficiency associated with such injectors is that the needle valves thereof exhibit significant non-ideal transient movement characteristics stemming from their utilization of spill valves which are subjected to the large forces of their hydraulic force imbalance systems. In particular, these designs typically utilize a "hold down" spring such as spring 21 of FIG. 1 which supplies approximately 30–40 pounds of force to urge the spill valve 26 into sealing engagement with the spill path 28 during the non-injection phase of the injection cycle. This relatively large force must be overcome by the solenoid actuator 30 before movement of the needle valve 14 can occur. This directly results in a number of disadvantages. First, a minimum threshold time period is required to create a sufficient magnetic force in the solenoid to initiate spill valve 26 movement and, hence, the injection phase of the injection cycle. Similarly, deenergization of the solenoid at the end of the injection phase requires an additional period to time. This presents a limitation on the rate at which multiple injections can occur during each injection cycle. Second, the rate at which the needle can be moved from one position to another is necessarily limited by the high spring force which must be overcome to cause needle movement. Third, once the spill valve reaches one of its two extreme positions, the problem of dissipating the significant kinetic energy contained therein inevitably results in one or more of overshoot, undershoot, bouncing (alternating overshoot and undershoot) or ballistic trajectory of the spill valve. Since this spill valve movement ultimately controls needle valve movement, all of the above defects result in corresponding defects in needle valve movement. In summary, fuel injectors described above are deficient in that actuator and needle valve movement imperfections yield less than ideal control of valve behavior.

These problems are further exacerbated in fuel injector designs employing a safety disconnect feature. Generally, such safety features attempt to control the various injection events of an injection cycle by separating the high-pressure fuel supply from the combustion chamber in the event of injector failure. Since the fuel supply is disconnected from the engine cylinder, hazardous conditions such as overfueling can be avoided in the event of nozzle fracture and/or other failure. Such designs exacerbate the above-described deficiencies because selectively disconnecting the injector from the supply rail places the additional requirements of high flow capacity and high response rates onto the already stringent performance characteristics demanded of such injectors.

Therefore, there remains a need in the art for an improved fuel injector which overcomes the aforementioned deficiencies of the prior art by utilizing a small hydraulic force imbalance scheme acting on the actuator to achieve desired variable position of the needle valve in place of the typical two position control.

Further, there remains a need in the art for an improved safety fuel injector which overcomes the aforementioned deficiencies of the prior art by providing an "off-cycle" disconnect feature which automatically disconnects the injector nozzle from the supply rail during the non-injection phase of each injection cycle.

Additionally, a need remains in the art for a fuel injector which is capable of modulating the needle valve position to thereby throttle the fuel passing from the fuel supply into the engine cylinder.

SUMMARY OF THE INVENTION

It is accordingly an object of the present invention to provide a fuel injector which utilizes a servo controlled force imbalance scheme to selectively inject fuel from a fuel supply into an engine cylinder.

It is further an object of the present invention to provide a fuel injector which is capable of modulating the needle valve position to thereby throttle the fuel passing from the fuel supply into the engine cylinder.

It is still another object of the present invention to provide a fuel injector which incorporates an improved safety-disconnect feature for automatically disconnecting the fuel supply from the injector nozzle during the non-injection phase of the fuel injection cycle.

It is another object of the present invention to provide a fuel injector which selectively permits injection of fuel from a fuel supply into an engine cylinder to thereby provide an optimal combination of (1) simplicity; (2) reliability; (3) efficiency; and (4) versatility.

These and other objects and advantages of the present invention are provided in one embodiment by providing a fuel injector to inject fuel into a cylinder of an internal combustion engine when installed therein, the engine having a high-pressure fuel supply which delivers fuel to the injector and a low-pressure fuel return which removes fuel from the injector. The injector has an injector body which defines an interior cavity, a movable needle valve which cooperates with the injector body to define a variable-volume control chamber and control valve means for selectively permitting variable fluid communication between the control chamber and (1) the high-pressure fuel supply; and (2) the low-pressure fuel return. Such fluid communication permits controlled variation of the volume of the control chamber which, in turn, varies the position of the needle valve to selectively permit or prevent fluid communication between the high-pressure fuel supply and the engine cylinder. The valve means for selectively permitting fluid communication is preferably force balanced by relatively low forces acting thereon. In an alternative embodiment, the valve means also includes a safety disconnect feature to selectively permit fluid communication between the high-pressure fuel supply and an auxiliary high-pressure fuel conduit (or region). In such an embodiment, the needle valve selectively permits or prevents fluid communication between an auxiliary fuel conduit of the injector body and the engine cylinder.

One clear advantage of the present invention over the related art is that the motion of the needle can be continuously varied during the fuel injection cycle. Thus, the needle position can be used to throttle the fuel injection rate via needle-to-seat flow restriction, a throttling scheme such as disclosed in U.S. Pat. No. Re. 34,999, "Hole Type Fuel Injector and Injection Method" or a functionally similar arrangement. This offers a significant increase in control and versatility over the "switch-type" injector actuation of the related art.

Another significant advantage of the present invention relative to the related art is that the injector of the present invention is capable of more closely approximating ideal injection characteristics. This is a direct result of the inventive utilization of a control valve means which is decoupled from the hydraulic forces acting on the needle valve position. Since the control forces acting on the valve means are not a function of nozzle/injection events, injectors of the instant invention are far more precise than those of the prior art. This precision is further enhanced because fuel flow within the injector is directly related to a controllable needle valve position. These advantages result in an injector which has the ability to produce multiple consistent and controlled injections per injection cycle which can, for example, be used to minimize combustion noise and NOX emissions.

The present invention also offers the advantage of easily implementing safety disconnect/enabling feature. This safety disconnect feature effectively provides an additional level of separation between the high pressure fuel supply and the engine cylinder during the non-injection portion of each injection cycle. In contrast to the safety disconnect features of the related art, the disconnect/enabling feature of the instant invention does not directly control the injection event. Rather, it provides an "off-cycle" disconnect to automatically prevent overfueling and engine damage in the event of injector breakage. Since this novel feature does not control the injection event, it can be added to the basic design of the instant invention with little or no degradation in injection efficiency and/or performance characteristics.

Numerous other advantages and features of the present invention will become apparent to those of ordinary skill in the art from the following detailed description of the invention, from the claims and from the accompanying drawings.

BRIEF DESCRIPTION OF THE DRAWINGS

The preferred embodiment of the present invention will be described below with reference to the accompanying drawings wherein like numerals represent like structures and wherein.

DESCRIPTION OF THE PREFERRED EMBODIMENTS

A first preferred embodiment of the injector according to the invention will be described with joint reference to FIGS. 2 and 3A through 3D. Those of ordinary skill in the art will readily appreciate that the injector 40 of FIG. 2 incorporates the present invention into an indirect servo-controlled common rail type fuel injector for use with a diesel engine. However, it will also be appreciated that the instant invention can be incorporated into a variety of other styles of known fuel injectors such as those for direct injection gasoline stratified charge engines.

Figure 1:
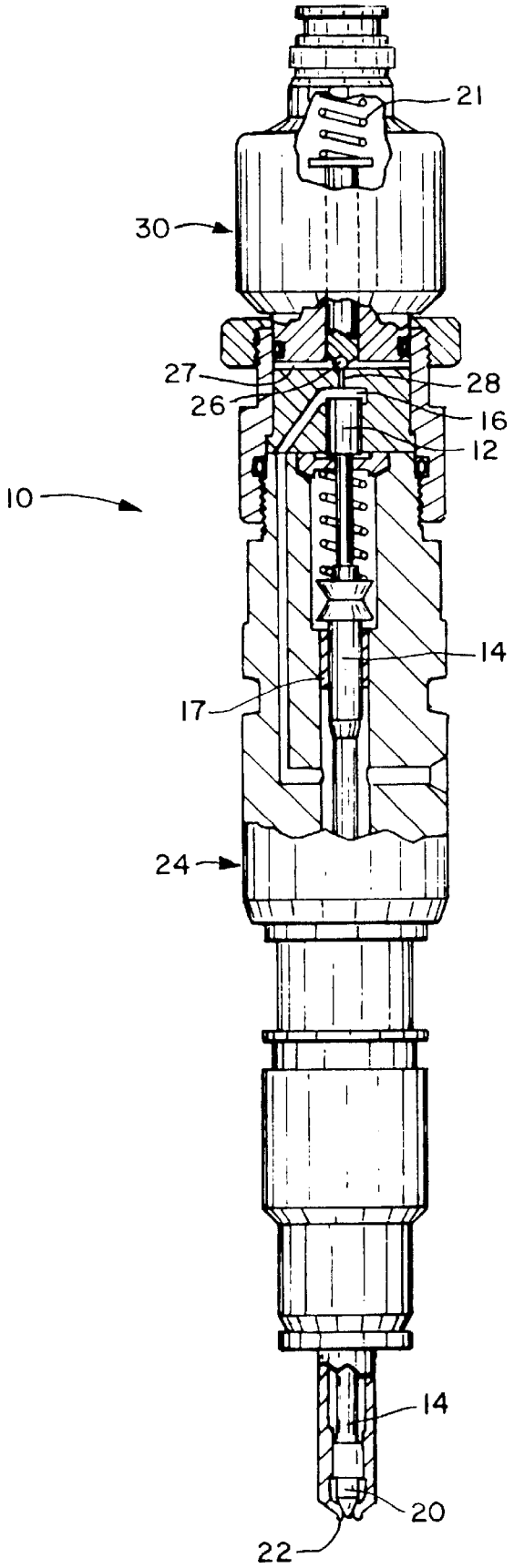
FIG. 1 PRIOR ART
FIG. 1 is a cross-sectional elevation view of a common rail injector of the related art.
Figure 2:
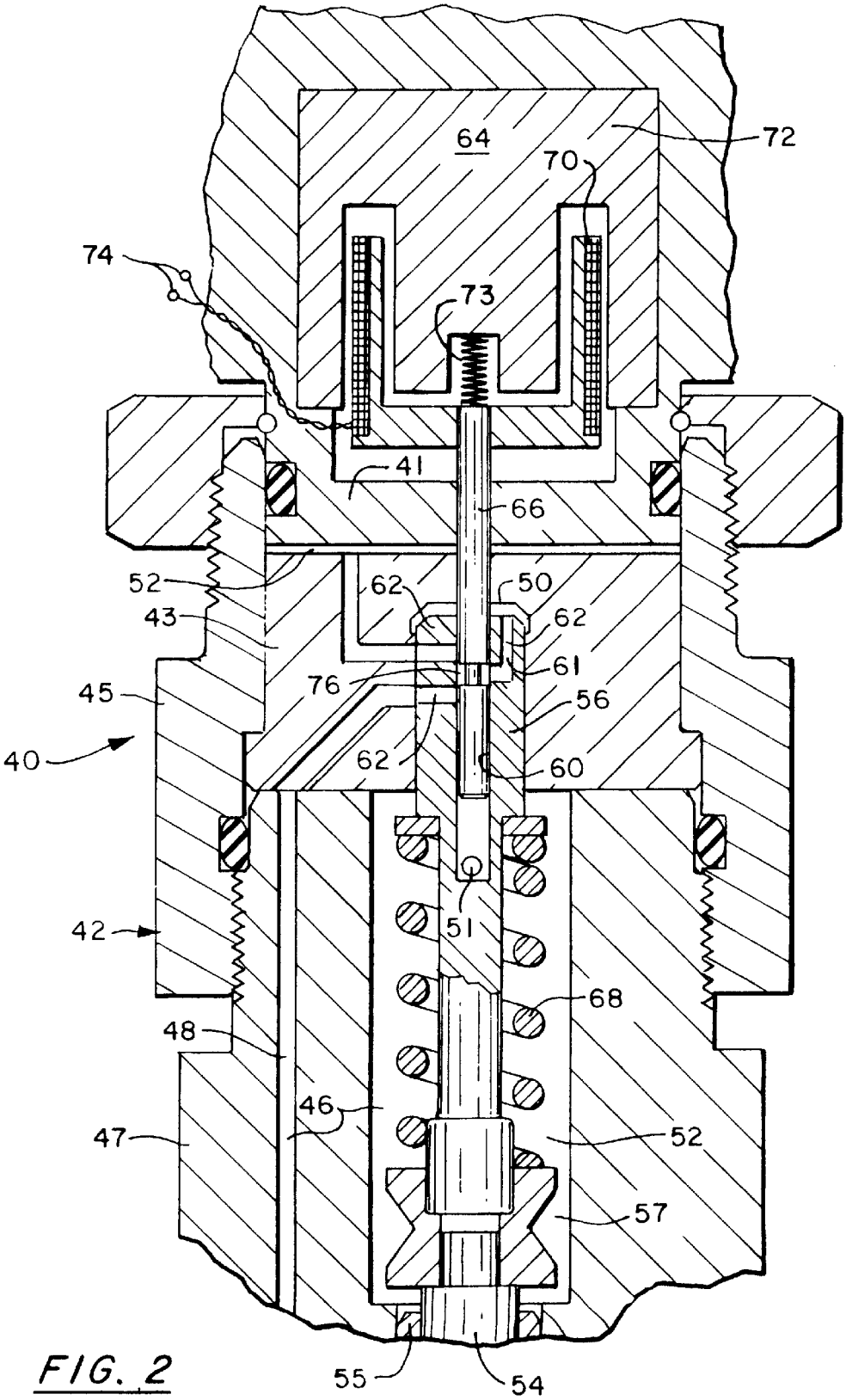
FIG. 2 is a cross-sectional elevation of a portion of one embodiment of the common rail injector of the present invention.

The servo controlled common rail injector 40 of FIG. 2 includes an injector body 42 which is comprised of a plurality of assembled components 41, 43, 45 and 47. This injector body 42 can be installed into an internal combustion engine (not shown) with the apertured injector nozzle (not shown) disposed within the engine cylinder. The internal combustion engine compartment in which the instant invention is used, preferably includes a high-pressure fuel supply (not shown) which delivers fuel at approximately 20,000 psi, or 1000 Bar, to the injector 40 and a low-pressure fuel return (not shown) which removes low-pressure fuel from the injector 40. The high-pressure fuel supply is preferably connected to a high-pressure fuel conduit region 48 of an interior cavity 46, defined within the injector body 42. The interior cavity 46 also includes a control chamber region 50 and a low-pressure fuel return region 52 extending therefrom. At least one nozzle aperture (not shown) extends through the injector body 42 in a nozzle region thereof and into the interior cavity 46 to permit fluid communication therebetween.

The injector further comprises a movable needle valve assembly 54 disposed within the interior cavity 46 for movement between fuel-blocking and fuel injection positions. The needle assembly 54 preferably includes a first end (not shown) which is capable of sealingly engaging the injection body 42 to block fuel passage through the nozzle aperture when the needle valve 54 is in the fuel-blocking position. It will be readily appreciated that the needle valve 54 can be shaped in a wide variety of ways to sealingly engage the injector body 42 to restrict the flow of fuel through the interior cavity 46 as desired. A second end of the needle valve 54 preferably comprises a power piston 56 which sealingly engages the injector body 42 to define a variable-volume control chamber 50 therebetween. The power piston 56 preferably includes a bore 60 axially extending through the center of the power piston 56 and a plurality of fluid paths 62 which are in fluid communication with the bore 60. As can be seen from FIG. 2, a control fluid path 61 is always in fluid communication with the control chamber 50 and the remaining fluid paths are selectively in fluid communication with the high-pressure fuel conduit 48 and the low-pressure fuel return conduit 52. Finally, needle assembly 54 also includes an annular seal 55 to prevent high-pressure fuel from entering a low-pressure spring region 57. It will be appreciated that this arrangement effectively force-balances needle 54 between the seal 55 and the piston 56 due to the force of the fuel pressure acting on these components.

FIG. 2 further depicts the injector of the instant invention as including an actuator 64 and a servo, or actuator, pin 66, extending therefrom and into the bore 60 of the power piston 56. In this Figure, the needle valve 54 is depicted in the fuel injection position and, thus, a bias spring 68, which acts to seal the injector when the engine is turned off, is depicted in a temporarily inoperative state. Also, servo pin 66 is freely movable within bore 60 and force balanced between low-pressure fuel acting on the end of servo pin 66 and an opposing low force spring 73 acting on an opposite end thereof, it will be appreciated that the actuator 64 is decoupled from the large and active transient pressures normally associated with common rail injectors. The diameter of pin 66 and the receiving bore 60 of piston 56 are preferably minimized to reduce the mechanical stresses produced within the power piston 56.

A variety of actuators which are widely known in the art may be adapted for use with the instant invention. However, a voice coil type actuator 64, having a moving coil 70 and a permanent magnet 72, is particularly well suited to the instant invention because, as current is applied to the coil, a reactant force is created which is proportional to the flux density and the current supplied thereto. Thus, reactant forces in both opposite directions (and of any desired magnitude) can be generated by supplying voltages of appropriate polarity and magnitude to the electric leads 74 of the coil 70. It will be readily appreciated that since the servo actuator 64 is decoupled from the hydraulic force imbalance scheme which is acting on the needle valve, high force outputs need not be generated by the actuator 64 to operate the instant invention. Thus, the driving force of the servo or actuator pin 66 is relatively low and the response of voice coil actuator 64 is particularly good. Finally, since the actuator 64 should have a stroke of at least the same magnitude as the device it is controlling, the preferred actuator 64 provides a stroke in the range of about 0.010" to about 0.017" in order to accommodate nozzle needle valve travel commonly used in diesel engines.

The use of a voice coil actuator provides the additional advantage that the needle valve position can be readily monitored. This is accomplished, for example, by incorporating a coil position sensor into the actuator assembly. Since the needle valve position is directly related to the actuator coil position, the position sensor readily yields position information for the needle valve. As an alternative to employing a coil position sensor, the needle valve position can be monitored by sensing the back electromotive force applied to the voice coil 70. For example, changes in electromotive force can indicate sudden deceleration of the coil as it reaches a travel stop. Thus, the electromotive force can be sensed by the driver circuitry, interpreted to indicate the position of the needle valve 54 and used to improve performance characteristics of the injector 40.

The servo pin 66 which extends from the actuator 64 is preferably sealingly received within the bore 60 of the power piston 56 for movement therein and preferably contains an annular recess 76 in the region which is received within the bore 60. Cooperation between the servo pin 66 and power piston 56 selectively permits or blocks fluid communication between the various fluid paths 62 of the power piston due to the relative movement between the servo pin 66 and power piston 56. Piston 56 includes an aperture 51 which places bore 60 in fluid communication with low-pressure fuel region 52'. The servo pin 66 is, thus, force balanced between low-force spring 73 and the low-pressure fuel from region 52 acting on one end of the servo pin 66. Naturally, the particular position of the servo pin 66 will be determined by the position of the actuator 64. The particular position of the power piston 56 will be dictated by the volume of fuel in the control chamber 50 as well as the opposing force presented on the other side of low pressure fuel region 52 by the high pressure fuel acting on seal 55.

Figures 3A, 3B, 3C, 3D:
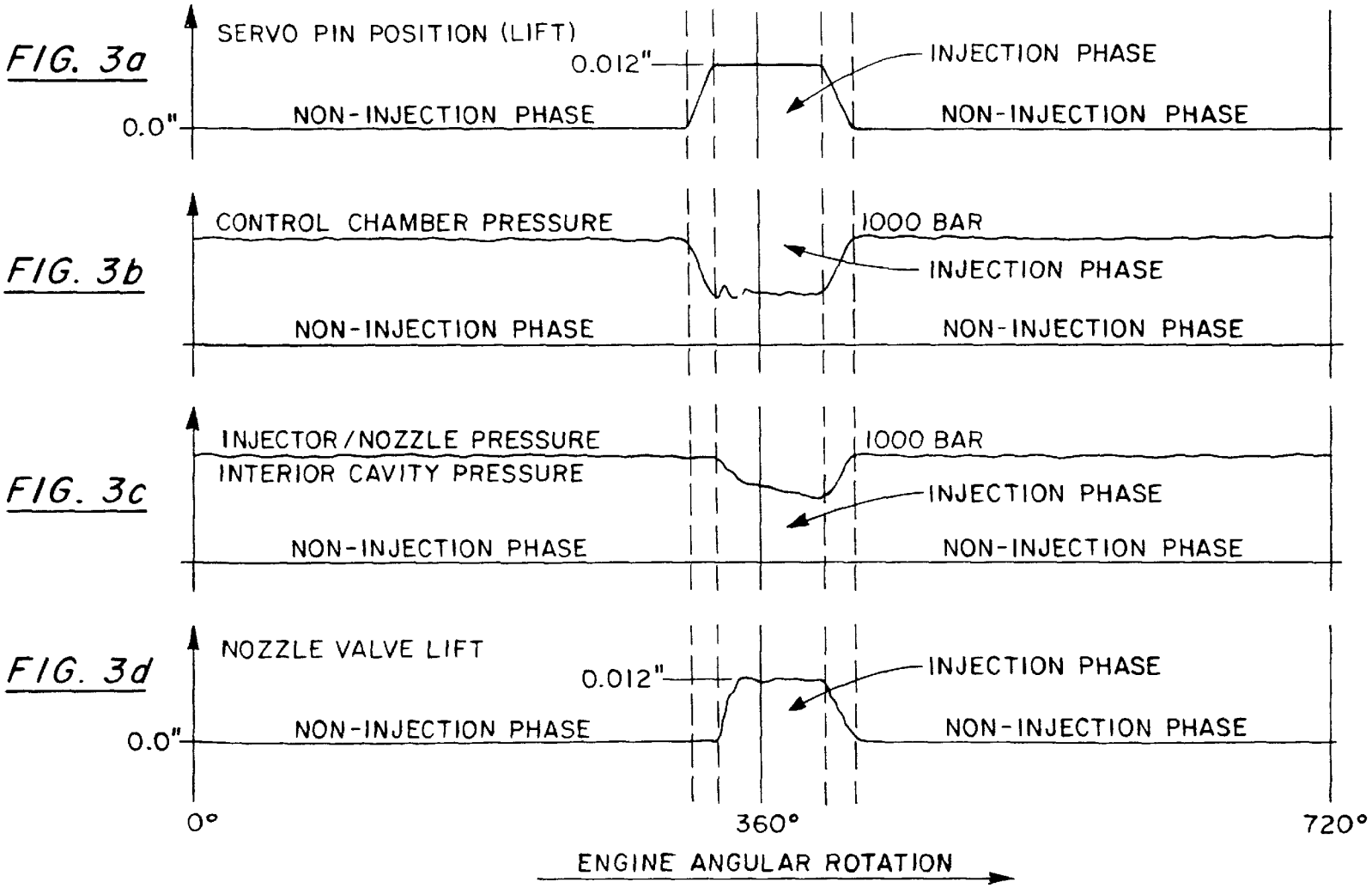
FIGS. 3A–3D illustrate the operation of the common rail injector depicted in FIG. 2 during the course of one injection cycle.

One example of the operation of the common rail injector 40 of FIG. 2 will now be described with joint reference to FIGS. 2 and 3. In the discussion below, the initial state of the various components is taken as the state of each component when the injector 40 is in the non-injection phase of the injection cycle. Injector component positioning during the injection phase of the injection cycle is shown in FIG. 2. FIGS. 3A–3D illustrate the operation of injector 40 over the course of one injection cycle and two revolutions of an associated engine.

During the non-injection phase, the servo pin 66 is in its initial position corresponding to a de-energized voice coil actuator 64. The force of the high-pressure fuel within the control chamber 50 overcomes that acting on seal 55 and drives the needle valve 54 into the fuel-blocking position. Thus, the needle valve 54 is in sealing engagement with the injector body 42 and fuel cannot flow through the apertured nozzle of the injector. Since the high-pressure fuel conduit 48 is in fluid communication with the control chamber 50 during the non-injection phase of the injection cycle, FIG. 3B shows that the control chamber 50 pressure is at approximately 1000 Bar. This corresponds with the high-pressure of the fuel from the fuel supply. Since the nozzle region of the interior cavity 46 is in fluid communication with the high-pressure fuel supply, it is also at the high-pressure level of 1000 Bar (See FIG. 3C). While some high-pressure fuel leakage can theoretically occur during the non-injection phase, this possibility is minimized due to small linear seal lengths of the various components of the injector.

The injection phase of the injection cycle commences with movement of the servo pin 66 from its initial position to an injection position. (See FIG. 3A) When the recess 76 of the servo pin 66 is positioned to permit fluid communication between the low-pressure fluid return conduit 52 and the control chamber 50, the control chamber pressure drops. (See FIG. 3B) Additionally, the high-pressure fuel conduit 48 is disconnected from the control chamber 50. The force acting on seal 55 urges the needle assembly 54 upwardly and the volume of the control chamber 50 decreases. Eventually, the needle valve 54 will lift so far as to disengage the connection with the low-pressure return conduit 52 and may even slightly overshoot to reestablish fluid communication between the control chamber 50 and the high-pressure fluid conduit 48. This movement of the needle valve 54 permits fuel to pass from the fuel supply, through the nozzle aperture (not shown) and into the engine cylinder (not shown). As can be seen from FIGS. 3A–3D, the scheme insures that the position of the needle valve 54 will be proportional to that of the servo pin 66.

At the end of the injection phase of the injection cycle, the actuator 64 is de-energized and the servo pin 66 once again assumes its initial position. Movement of the servo pin 66 permits fluid communication between the high-pressure fuel conduit 48 and the control chamber 50. This, in turn, increases the pressure and volume in the control chamber 50 until the power piston 56 drives the needle valve 54 back to its initial state against the force acting on seal 55. One simple injection cycle is, thus, completed. Naturally, this process can be repeated as desired.

While the example above shows that the injector 40 of the instant invention can act as a switch, it will also be readily appreciated that by applying proper voltages to the actuator 64, the position of the needle valve 54 can be modulated to thereby throttle the amount of fuel supplied through the nozzle aperture. Thus, a wide variety of injection cycle profiles can be achieved.

Figure 4:
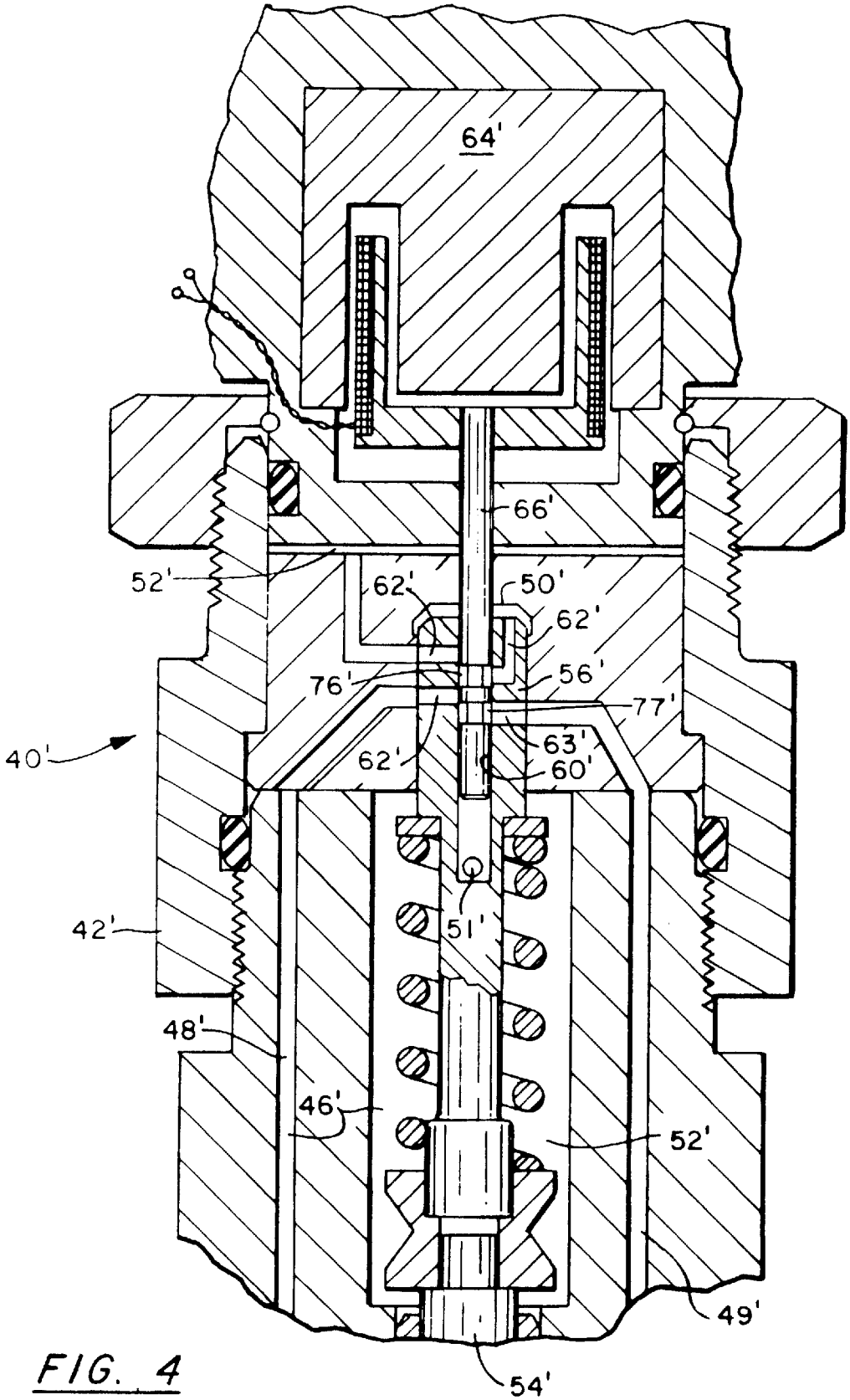
FIG. 4 is a view, similar to that of FIG. 2, of another embodiment of the injector of the present invention which employs a safety disconnect feature.

An embodiment of the instant invention employing a safety disconnect feature is illustrated in FIG. 4. The structure and operation of this embodiment is substantially similar to that described above with respect to FIGS. 2 and 3 with the following primary exceptions. First, the high pressure fuel supply is not directly connected to the apertured nozzle (not shown). Rather, fuel may only be injected through the nozzle aperture after it has passed through the high-pressure fuel conduit 48' and an auxiliary high-pressure fuel conduit 49'. Thus, the needle valve 54' selectively blocks and permits fluid communication between the auxiliary high-pressure fuel conduit 49' and the apertured nozzle. Second, the servo pin 66' employs a first and a second annular recess 76' and 77' along the length thereof to selectively permit fluid communication between the various fluid paths 62' of the power piston 56'. Finally, an additional fluid path 63' is provided in the power piston 56'. This fluid path 63' cooperates with a corresponding fluid path on the opposite side of the piston bore 60' to permit fluid communication between the high-pressure fuel conduit 48' and the auxiliary high-pressure fuel conduit 49' when one of the servo pin recesses 76' and 77' is aligned therewith.

Figures 5A, 5B, 5C:
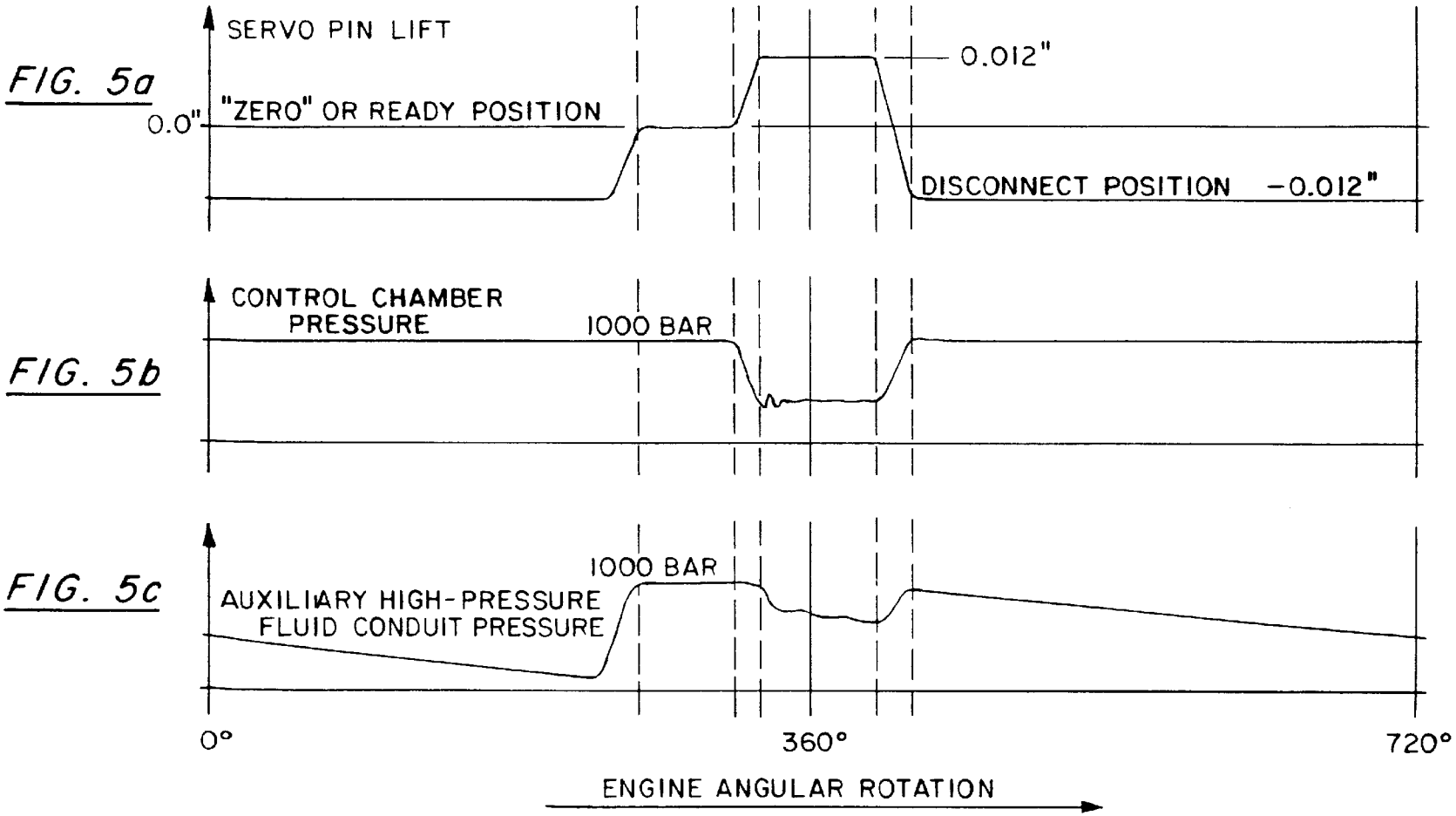
FIGS. 5A–5E illustrate the operation of the common rail injector of FIG. 4 during the course of one injection cycle.
Figures 5D, 5E:
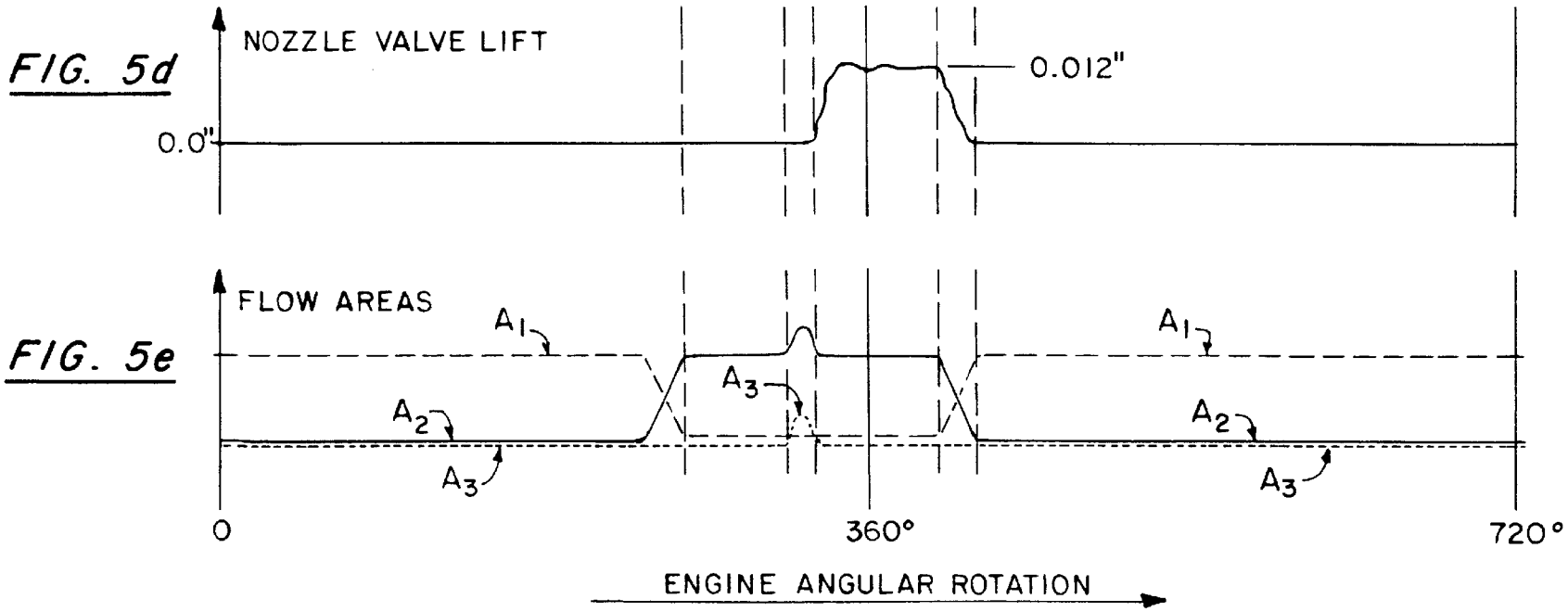

One example of the operation of the injector 40' of FIG. 4 will be generally described below with joint reference to FIG. 4 and FIGS. 5A–5E starting with the non-injection phase of the injection cycle. Whereas FIGS. 5A, 5B and 5D are generally analogous to FIGS. 3A, 3B and 3D of the previously described embodiment, FIG. 5C represents the pressure within the auxiliary high-pressure fluid conduit region 49' of the FIG. 4 embodiment. Additionally, FIG. 5E depicts fluid communication within the various regions of the interior cavity 46'. In FIG. 5E, dashed line $A_1$ represents fluid communication between the high-pressure fuel supply and control chamber 50'. Solid line $A_2$ represents fluid communication between the high-pressure fuel supply and auxiliary high-pressure fluid conduit 49'. And, dashed line $A_3$ represents fluid communication between control chamber 50' and low-pressure return conduit 52'.

In this embodiment of the servo controlled common rail injector 40', the de-energized condition of the voice coil actuator 64' results in the servo pin 66' assuming an initial position which corresponds to that of the embodiment discussed above. Similarly, the control chamber volume is maximized and the needle valve 54' is sealingly engaged to the injector body 42' to prevent fluid from flowing through the nozzle aperture(s). However, since, the auxiliary high-pressure fuel conduit 49' is disconnected from the high-pressure fuel conduit 48' during most of the non-injection phase, the fuel pressure existent therein is significantly less than that of the high-pressure fuel conduit 48'. Thus, during the non-injection phase, the control chamber 50' is in fluid communication with the high-pressure fuel conduit 48', the high-pressure fuel conduit 48' is not in fluid communication with the auxiliary high-pressure fuel conduit 49' and the control chamber 50' is not in fluid communication with the low-pressure return conduit 52'.

Prior to initiation of the injection phase, the voice coil 64' is partially energized which causes the servo pin 66' to assume a "zero" or ready position. This movement of the servo pin 66' is sufficient to permit fluid communication between the high-pressure fuel conduit 48' and the auxiliary high-pressure fuel conduit 49'. However, this movement does not interrupt the fluid communication between the high-pressure fuel conduit 48' and the control chamber 50'. Nor does it permit fluid communication between the control chamber 50' and the low-pressure return conduit 52'. Thus, needle valve 54' does not move.

During the injection phase, however, the actuator 64' is further energized and the servo pin 66' moves to a second, or an injection, position. During such movement fluid communication between the control chamber 50' and the high-pressure fuel conduit 48' is interrupted and fluid communication between the low-pressure fuel conduit 52' and the control chamber 50' is commenced. Accordingly, the pressure in the control chamber is released and the volume of the control chamber decreases to a minimum value. Once the servo pin 66' has reached the injection position, fluid communication between the high-pressure fuel conduit 48' and the auxiliary high-pressure fuel conduit 49' is established and the needle valve 54' is no longer sealingly engaged with the injector body 42'. Accordingly, fuel is permitted to pass from the high-pressure conduit 48' through the apertured nozzle and into the engine cylinder (not shown).

At the end of the injection phase of the injection cycle, the servo pin 66', once again, assumes its initial position which causes the volume of the control chamber 50' to increase and the needle valve 54' is urged back to its fluid-blocking position. Further, the auxiliary high-pressure fuel conduit 49' is disconnected from the high-pressure fuel conduit 48'. This causes the pressure existent therein to gradually decay due to leakage. Once this injection cycle has been completed, it may, obviously, be repeated as desired.

Since the safety disconnect/enabling feature of the instant invention operates automatically during each injection cycle, it is more reliable and effective than previous safety disconnect schemes. These previous safety schemes require that error detection occur before any corrective safety action is initiated. These schemes, thus, often operate too slowly to prevent engine damage. By contrast, automatic operation of the disconnect feature of the present invention provides an approximate enabling of the intended injection event even in the case of a failed nozzle tip. For example, this disconnect/enabling feature will allow fuel injection to occur within the enabled phase which, while not meeting the precise intended calibration, will provide motive force and will not result in engine damage.

Many variations of the present invention are possible. For example, the relative positions of the high-pressure fuel conduit and the low-pressure return conduit can be altered such that the movement of the needle valve is inversely related to the movement of the servo pin. Additionally, the number, position, shape and size of the recesses of the servo pin can be modified as desired. Similarly, the number, size, shape and position of the fluid paths extending through the power piston can be altered as desired. Alteration of the servo pin and power piston in this manner provides the ability of a wide variety of injection cycles. This provides the ability to cause multiple injection events with a single movement of the servo pin. Naturally, and as noted above, the principles of the present invention discussed herein are readily adaptable to a wide variety of well known and commonly used types of fuel injectors.

While the present invention has been described in connection with what is presently considered to be the most practical and preferred embodiments, it is to be understood that the invention is not limited to the disclosed embodiments, but is intended to cover various modifications and equivalent arrangements included with the spirit and scope of the appended claims.

I claim:

1. A fuel injector of the type used to inject fuel into a cylinder of an internal combustion engine when installed therein, the engine having an associated high-pressure fuel supply which delivers fuel to said injector and a low-pressure fuel return by which fuel is removed from said injector, said injector comprising:

an injector body which defines an interior cavity, said interior cavity including a control region, a high-pressure fuel region fluidly connected with the high-pressure fuel supply, a nozzle region fluidly connected with the high pressure fuel supply and at least partially situated in the engine cylinder for injecting fuel into the cylinder, and a low-pressure fuel region fluidly connected with the low pressure return;

a needle valve assembly at least partially disposed within said injector cavity for movement between first and second positions, said needle valve assembly having a control surface In said control region and having an injection portion which blocks fuel flow through said nozzle region when said needle is in said first position and permits flow through said nozzle region into said cylinder when said needle is in said second position; and control valve means for selectively permitting fluid communication between said high-pressure fuel region and said control region and between said low-pressure fuel region and said control region to thereby selectively vary the volume of said control region acting on the control surface to displace said needle assembly between said first and second positions, said valve means comprising:

a piston which sealingly engages said body to define said control region, said piston being affixed to said needle valve assembly and including first, second and third fuel paths and a pin-reception aperture, said first, second and third fuel paths being fluidly connected to said pin-reception aperture, said first path being capable of being fluidly connected with said high pressure fuel region, said second path being capable of being fluidly connected with said low-pressure fuel region and said third path being fluidly connected with said control region;

a pin at least partially sealingly disposed within said pin-reception aperture for movement between an initial and an injection position, said pin having a recess which fluidly connects said first and third paths of said piston portion when said pin is in said initial position to thereby urge said needle into said first position, said pin recess fluidly connecting said second and third paths of said piston portion when said pin is in said injection position to thereby urge said needle into said second position; and an actuator connected to said pin for selectively urging said pin between said initial injection positions.

2. A fluid injector for use with a high-pressure fluid supply and a low-pressure fluid return comprising:

an injector body comprising means defining an interior cavity which includes means defining a high-pressure fluid conduit which is fluidly connected to the high-pressure fluid supply;

means defining a low-pressure fluid conduit which is fluidly connected to the low-pressure fluid return; and means defining at least one injection aperture extending through said injector body and into said interior cavity means;

a needle valve assembly having a first end and an opposite second end, said needle valve assembly being a least partially disposed within said interior cavity for movement therein such that said first end cooperates with said injector body to selectively permit fluid flow between said interior cavity and said aperture, and such that said second end cooperates with said interior cavity to define a variable volume control chamber, said second end including means defining a plurality of fluid paths and a bore which is in fluid communication with said fluid paths, at least one of said fluid paths being in fluid communication with said control chamber;

an actuator pin at least partially disposed in said bore of said second needle end for movement therein, said pin selectively permitting fluid communication between said control chamber and at least one of said high-pressure conduit and said low-pressure conduit via said fluid paths as said pin moves in said bore; and an actuator connected to said pin for selectively urging said pin between an initial position wherein said fluid paths and said pin recess cooperate to permit fluid communication between said high-pressure fluid conduit and said control chamber whereby said first end of said needle prevents fluid flow between the fuel supply and said aperture, and an injection position wherein said fluid paths and said pin recess cooperate to permit fluid communication between said low-pressure conduit and said control chamber whereby said first end of said needle permits fluid flow between the fuel supply and said aperture.

3. The injector of claim 2, wherein said actuator is an electrically controlled voice coil.

4. The injector of claim 2, further comprising an actuator pin position sensor for detecting the position of said actuator pin.

5. The injector of claim 2, wherein said actuator is a voice coil and wherein said voice coil includes a coil position sensor.

6. The injector of claim 2, wherein the volume of said control chamber varies between a minimum value and a maximum value as the position of said actuator pin varies between said initial and said injection positions.

7. The injector of claim 2, wherein said pin recess is only in fluid communication with one of said high pressure conduit means and said low pressure conduit means at any given time.

8. The injector of claim 2, further comprising means for pre-biasing said needle whereby said first end of said needle is urged toward said aperture.

9. The injector of claim 2, wherein said needle is disposed within said interior cavity means for movement therein such that said first end thereof cooperates with said injector body to throttle fluid flow between said interior cavity means and said aperture means.

10. A fuel injector of the type used to inject fuel into a cylinder of an internal combustion engine when installed therein, the engine having a high-pressure fuel supply which delivers fuel to said injector and a low-pressure fuel return which removes fuel from said injector, said injector comprising:

an injector body which defines an interior cavity, said interior cavity including:

a variable-volume control region, a high-pressure fuel region fluidly connected with the high-pressure fuel supply, an apertured nozzle region fluidly connected between the high-pressure fuel supply and the engine cylinder when said injector is installed in the engine, and a low-pressure fuel region fluidly connected with the low pressure fuel return;

a needle valve assembly at least partially disposed within said interior cavity of said body for movement between first and second positions, said needle having an injection portion which is capable of blocking fluid flow between the high-pressure fuel supply and the engine cylinder when said needle is in said first position and a piston portion which sealingly engages said body to define said control region of said interior cavity, said piston portion defining first, second and third fuel paths and a pin-reception aperture, said first, second and third fuel paths being fluidly connected to said pin-reception aperture, said first path being capable of being fluidly connected with said high pressure fuel region of said interior cavity, said second path being capable of being fluidly connected with said low-pressure fuel region of said interior cavity and said third path being fluidly connected with said control region of said interior cavity;

a servo pin at least partially sealingly disposed within said pin-reception aperture for movement between an initial and an injection position, said servo pin having a recess which fluidly connects said first and third paths of said piston portion when said pin is in said initial position to thereby urge said needle into said first position, said pin recess fluidly connecting said second and third paths of said piston portion when said pin is in said injection position to thereby urge said needle into said second position; and a servo actuator connected to said pin for selectively urging said pin between said initial and injection positions.

11. The injector of claim 10, wherein said actuator is an electrically controlled voice coil.

12. The injector of claim 10, further comprising an actuator pin position sensor for detecting the position of said servo pin.

13. The injector of claim 10, wherein said actuator is a voice coil and wherein said voice coil includes a coil position sensor.

14. The injector of claim 10, wherein said actuator is capable of selectively urging said servo pin into a plurality of positions between said initial position and said injection position whereby said needle is urged into a plurality of positions between said first and second positions.

15. The injector of claim 10, further comprising means for urging said needle into said second position.

16. The injector of claim 10, wherein the volume of said control region varies between a minimum and a maximum valve as the position of said servo pin varies between said initial and said injection positions.

17. The injector of claim 10, wherein said pin recess only in fluid communication with one of said high pressure fuel region and said low pressure fuel region at any given time.

* * * * *